US007410233B2

(12) United States Patent
Kitami et al.

(10) Patent No.: US 7,410,233 B2
(45) Date of Patent: Aug. 12, 2008

(54) LIQUID DROPLET EJECTING APPARATUS AND A METHOD OF DRIVING A LIQUID DROPLET EJECTING HEAD

(75) Inventors: Akiko Kitami, Hino (JP); Kazuo Asano, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 296 days.

(21) Appl. No.: 11/294,662

(22) Filed: Dec. 5, 2005

(65) Prior Publication Data

US 2006/0125856 A1 Jun. 15, 2006

(30) Foreign Application Priority Data

Dec. 10, 2004 (JP) ..... 2004-357826

(51) Int. Cl.
*B41J 29/38* (2006.01)

(52) U.S. Cl. ..... 347/11; 347/10

(58) Field of Classification Search ..... 347/10, 347/11, 57, 9, 68
See application file for complete search history.

(56) References Cited

U.S. PATENT DOCUMENTS 6,099,103 A * 8/2000 Takahashi ..... 347/11
6,290,315 B1 * 9/2001 Sayama ..... 347/10
6,328,398 B1 * 12/2001 Chang ..... 347/11
6,450,603 B1 * 9/2002 Chang ..... 347/10
6,899,409 B2 * 5/2005 Kusunoki ..... 347/11
2004/0155915 A1 * 8/2004 Kitami et al. ..... 347/10

FOREIGN PATENT DOCUMENTS

JP 2003-276200 9/2003

* cited by examiner

*Primary Examiner*—Stephen D. Meier
*Assistant Examiner*—Rene Garcia, Jr.
(74) *Attorney, Agent, or Firm*—Lucas & Mercanti, LLP

(57) ABSTRACT

A liquid droplet ejecting apparatus having: a pressurizing device; a pressure generation chamber whose volume expands or contracts by a movement of the pressurizing device; a liquid droplet ejecting head having a nozzle communicating with the pressure generation chamber; and a drive signal generator which generates the drive signal for operating the pressurizing device, and causing to eject liquid droplets through the nozzle, wherein the drive signal comprises: an expansion pulse to expand the volume of the pressure generation chamber; a first contraction pulse following the expansion pulse to contract the volume; and a second contraction pulse after the first contraction pulse to contract the volume, wherein a pulse width of the expansion pulse is 0.7AL through 1.3AL, and a pulse width of the first contraction pulse is 0.3 AL through 1.5 AL, where AL is ½ of an acoustic resonance period of the pressure generation chamber.

14 Claims, 13 Drawing Sheets

FIG. 3 ( a )
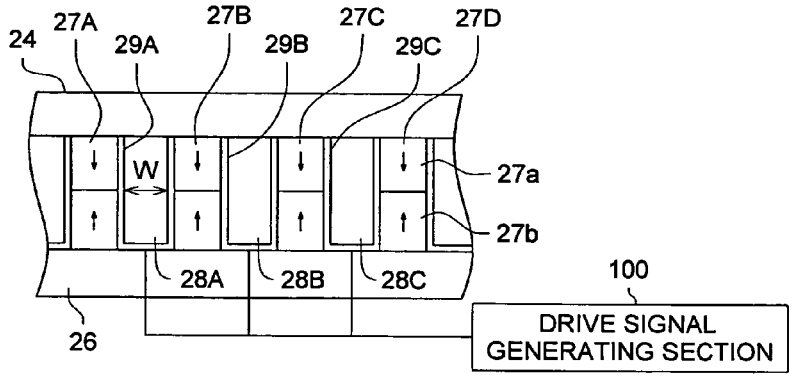
FIG. 3 ( b )
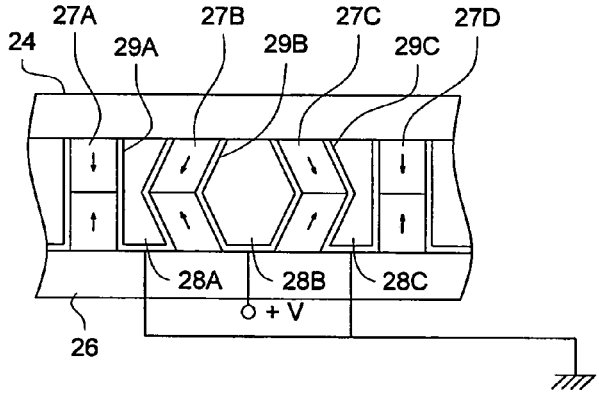
FIG. 3 ( c )
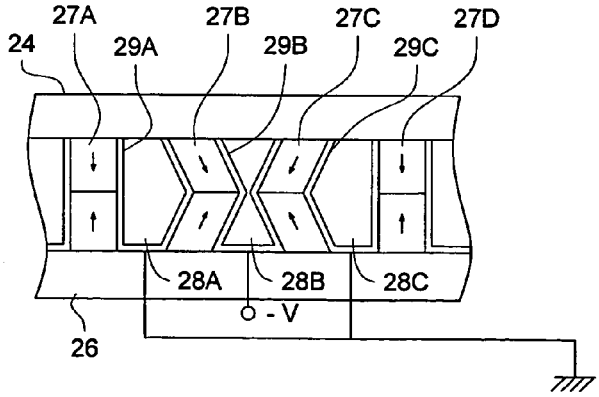

FIG. 4 ( a )
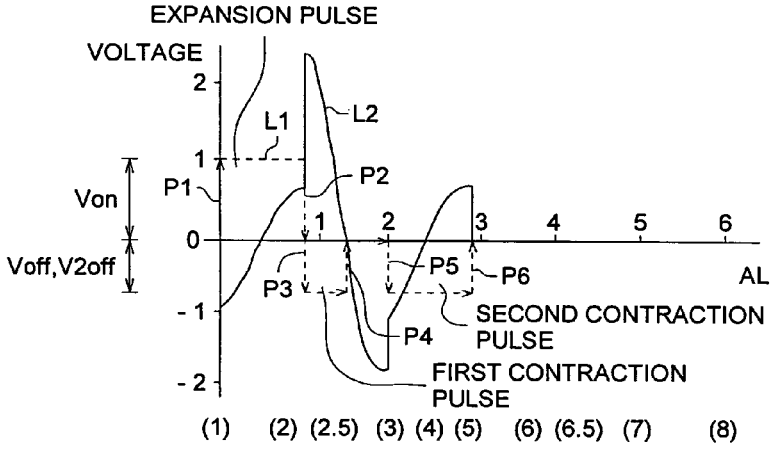
FIG. 4 ( b )
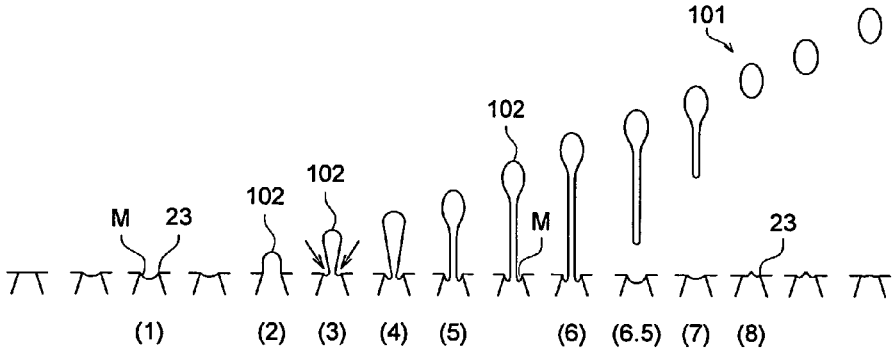

FIG. 5 ( a )
PRIOR ART
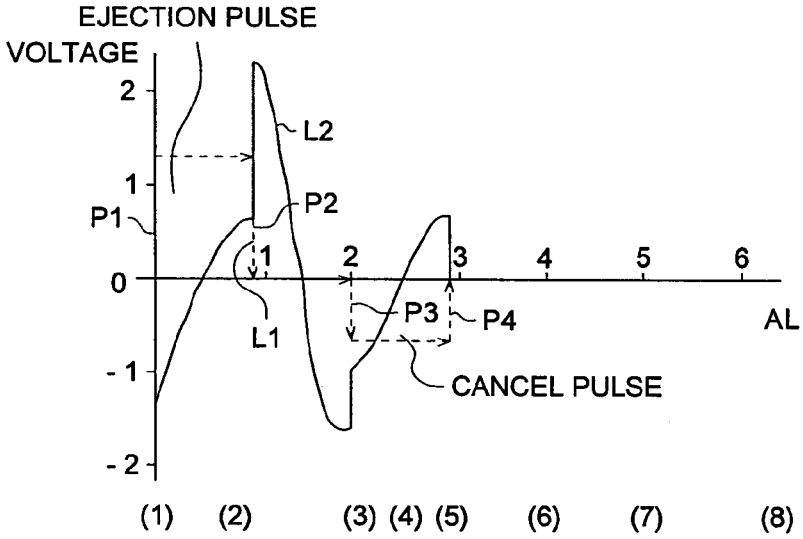
FIG. 5 ( b )
PRIOR ART
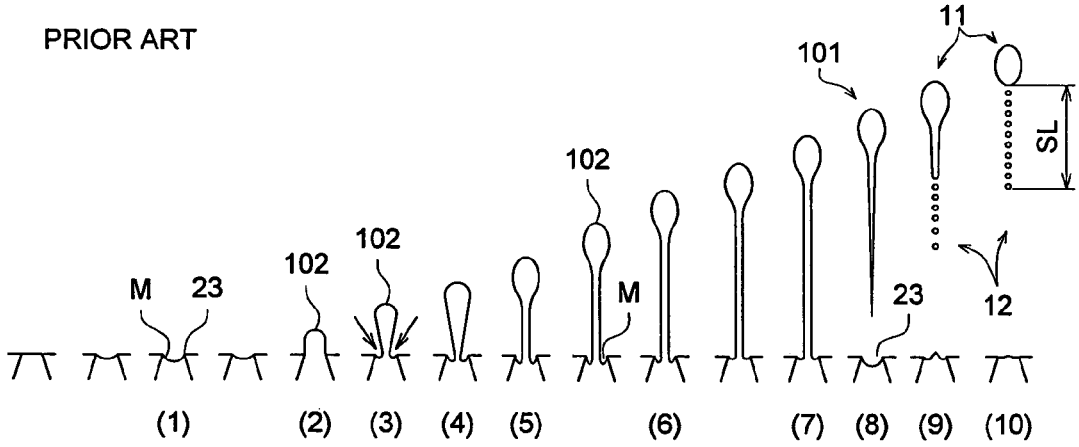

FIG. 6 ( a )
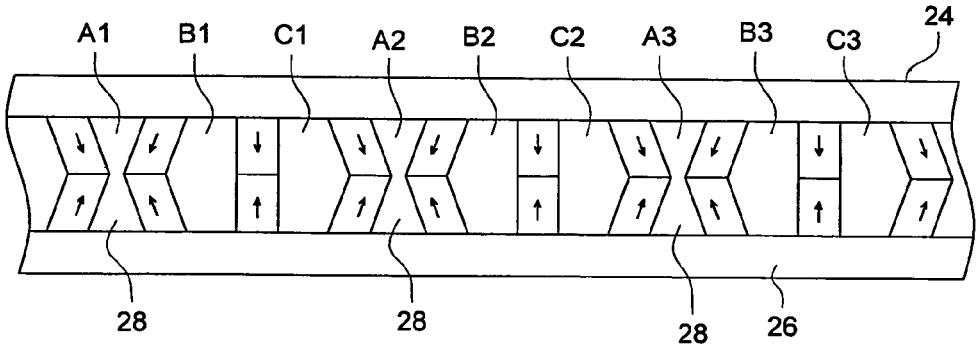
FIG. 6 ( b )
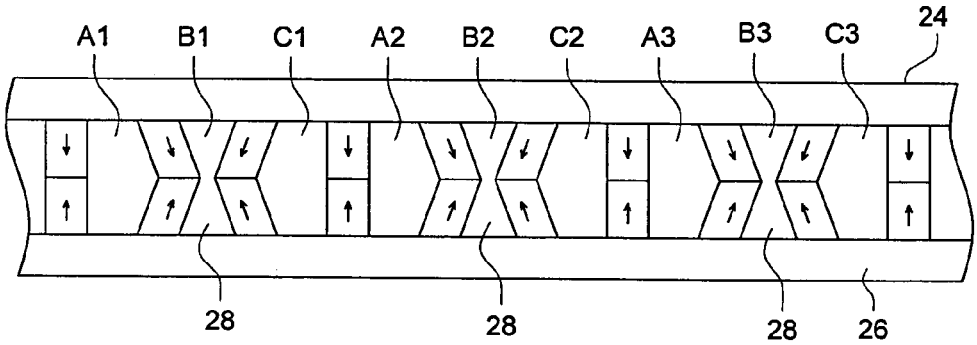
FIG. 6 ( c )
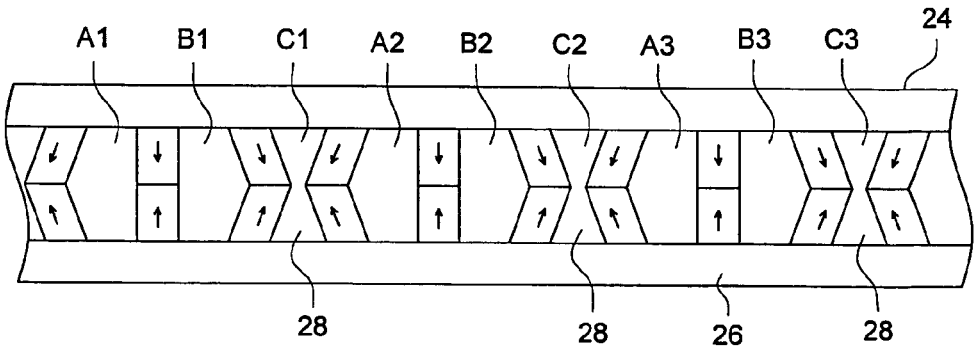

LIQUID DROPLET EJECTING APPARATUS AND A METHOD OF DRIVING A LIQUID DROPLET EJECTING HEAD

BACKGROUND OF THE INVENTION

1. Field of the Invention

This invention relates to a liquid droplet ejecting apparatus and a method of driving a liquid droplet ejecting head which ejects liquid droplets through nozzles.

2. Description of Related Arts

An ink jet recording head (hereinafter simply referred to as a recording head) is used to record images with very small ink droplets. A liquid droplet ejecting head as the ink jet recording head which ejects liquid droplets through nozzles jets out liquid droplets onto a recording medium such as a sheet of recording paper by giving a pressure to a pressure generation chamber.

Various kinds of pressurizing devices have been available to give pressures to the pressure generation chambers. Among the pressurizing devices, we briefly explain a recording head which is disclosed by Patent Document 1 referring to FIGS. 12(*a*) and (*b*). The partition walls of the pressure generation chamber are made of piezoelectric elements and deformed to eject ink droplets through nozzles.

As shown in FIGS. 12(*a*) and (*b*), the above shear-mode recording head 600 contains bottom wall 601, ceiling wall 602 and shear-mode actuator walls 603 therebetween. Each actuator wall 603 contains lower wall 607 which is bonded to bottom wall 601 and polarized in the arrow direction 611 and upper wall 605 which is bonded to ceiling wall 602 and polarized in the arrow direction 609. A pair of actuator walls 603 forms ink flow channel 613 which work as a pressure generation chamber therebetween. Nearby actuator walls 603 of two pairs of adjacent actuator walls form space 615 which is narrower than ink flow channel 613. This space 615 is a dummy channel and does not eject ink. In other words, this head is a so-called dummy channel type head.

Nozzles plate 617 with nozzle 618 is firmly fixed to one end of each ink flow channel 613. Each surface of actuator wall 603 has a metal layer of electrode 619 or 621. Each of electrodes 619 and 621 is covered with an insulating layer (not shown in drawings) to insulate from ink. Electrodes 621 facing to space 615 is connected to ground 623. Electrode 619 provided in ink flow channel 613 is connected to silicone chip 625 which works as an actuator driving circuit.

Meanwhile, for fast recording of ink jet images, it is necessary to drive recording head 600 at a high-frequency and eject ink droplets at shorter cycles. Specifically, to accomplish high-frequency greyscale driving, it is necessary to eject an ink droplet and the next droplet promptly and stably through the identical nozzle.

For this purpose, Patent Document 1 discloses a method of applying a cancellation pulse after ejecting an ink ejection pulse to reduce a pressure change in ink flow channel 613 which is a pressure generation chamber.

In other words, this method applies a cancellation pulse to generate a pressure wave whose phase is opposite to a pressure change in ink flow channel 613 a preset time later after an ink droplet is ejected. As shown in FIG. 13, a cancellation pulses D (pulse width AL) whose phase is opposite to that of ejection pulse C is applied to electrode 619 of ink flow channel 613 time lapse AL later after ejection pulse C falls. Here, AL is ½ of an acoustic resonance period of the pressure generation chamber.

The voltage value of the cancellation pulse is determined according to the amplitude of a pressure change to cancel the change (for example, 0.6 time of the ejection pulse voltage). When receiving this cancellation pulse, actuator wall 603 deforms in a direction opposite to deformation of the actuator wall at the time of ink ejection. This eliminates a change in ink ejection velocity when the frequency of drive pulses is changed and consequently improves the printout quality. This also enables quick stable ejection of a succeeding ink droplet after ejection of an ink droplet through an identical nozzle. Consequently, the recording head can be driven at a high frequency and eject ink droplets at a shorter cycle.

[Patent Document 1] Japanese Non-Examined Patent Publication 2003-276200

This method like a conventional driving method can cancel a pressure wave in a pressure generation chamber by applying a cancellation pulse. Thereby, the recording head can greatly attenuate the meniscus vibration due to a pressure wave in the pressure generation chamber and start ejection of the next ink droplet.

FIG. 5(*b*) shows a behavior of an ink meniscus in a nozzle and how a liquid droplet is ejected in a conventional driving method. FIG. 5(*b*) shows nozzle 23, ink pillar 102, ink droplet 101, main droplet 11, satellite droplet 12, and meniscus M. FIGS. 5(*a*), (*b*) will be explained in detail later.

From present inventors' stock of information, the following is found:

When a cancellation pulse is applied to cancel a pressure wave as disclosed in the above prior art as shown in FIG. 5(*b*), ink pillar 102 still has its root in meniscus M. (See FIG. 5(*b*)-(3) and (5).) As ink pillar 102 extends away from nozzle 23, ink pillar 102 is pulled by the moving energy of the main droplet and becomes longer since only the surface tension of the ink works to cut off the ink pillar 102. Then, the separated ink droplet 101 also becomes longer and consequently the velocity difference between the top and tail of the ink droplet becomes greater. When the flying force of the liquid pillar overcomes the surface tension which works to cut off the liquid pillar, ink droplet 101 is apt to part into main droplet 11 which has a preset volume and a preset ejection velocity and satellite droplets 12 each of which has smaller volume and ejection velocity than those of the main droplet volume. Consequently, the number of satellite droplets 12 increases. (See FIG. 5(*b*)-(9) and (10).)

This phenomenon appears more eminently when ink of a low surface tension or high viscosity is ejected.

Such satellite droplets 12 will land off the landing position of main droplet 11, which causes the deterioration of image qualities.

In the above ink jet recording head, any crud in the vicinity of a nozzle on the outer side of the nozzle forming member will interfere with the ejection of ink, causing the ejected ink to change its flight, to be dragged in and deposited near the nozzle. Further, it frequently occurs that satellite droplets 12 float around the recording head and are deposited near the nozzles on the outer side of the nozzle forming member. This also causes the above problem.

Besides, when satellite droplets 12 increase its number, the ink mist increases in the recording apparatus. The ink mist will contaminate the inside of the apparatus and, in an extreme case, the ink mist deposits on electric contacts and causes malfunction of the apparatus.

This invention has been made in view of the above problems and an object of this invention is to provide a liquid droplet ejecting apparatus which can be driven at a high-frequency, reduce the number of satellite droplets, and ejects liquid droplets steadily, and a method of driving a liquid droplet ejecting head to accomplish the object.

SUMMARY OF THE INVENTION

One aspect of features of the embodiment to accomplish the object of the invention is a liquid droplet ejecting apparatus comprising a pressurizing device which is operated by drive signals, a pressure generation chamber whose volume expands or contracts by the movement of the pressurizing device, a liquid droplet ejecting head having a nozzle which communicates with the pressure generation chamber, and a drive signal generator which generates a drive signal to eject liquid droplets through the nozzle by applying a drive signal to the pressurizing device and expanding or contracting the volume of the pressure generation chamber, wherein a drive signal contains an expansion pulse to expand the volume of the pressure generation chamber, a first contraction pulse to contract the volume of the pressure generation chamber after the expansion pulse, and a second contraction pulse to contract the volume of the pressure generation chamber after the first contraction pulse.

BRIEF DESCRIPTION OF THE DRAWINGS

FIG. 2(*a*) is an oblique perspective Figure of a shear-mode ink jet recording apparatus which partially shows a sectional view. FIG. 2(*b*) is a sectional view of a shear-mode ink jet recording apparatus with an ink supply section.

FIGS. 3(*a*) to (*c*) show the operations of the recording head.

FIG. 4(*a*) shows a drive signal to realize the driving method of an embodiment of this invention and how a drive signal gives a pressure to ink in the pressure generation chamber. FIG. 4(*b*) shows a behavior of an ink meniscus and ejection of a liquid droplet by the driving method of an embodiment of this invention.

FIG. 5(*a*) shows a drive signal to realize a conventional driving method and how a drive signal gives a pressure to ink in the pressure generation chamber. FIG. 5(*b*) shows a behavior of an ink meniscus and ejection of a liquid droplet by the conventional driving method.

FIGS. 6(*a*) to 6(*c*) are explanatory drawings of time-division operation of the recording head.

DETAILED DESCRIPTION OF THE PREFERRED EMBODIMENTS

Figure 1:
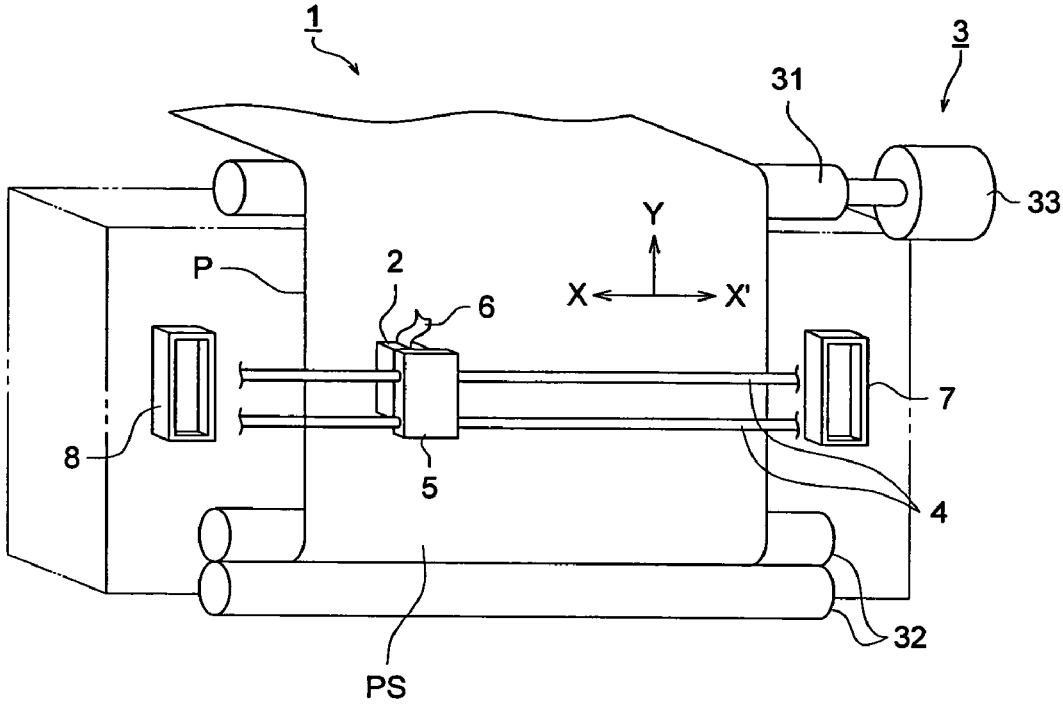
FIG. 1 is a schematic configuration of an ink jet recording apparatus.

The object of this invention can be accomplished by the following items of embodiments.

(1) A liquid droplet ejecting apparatus comprising:

a pressurizing device to be operated by a drive signal;

a pressure generation chamber whose volume expands or contracts by a movement of the pressurizing device;

a liquid droplet ejecting head having a nozzle communicating with the pressure generation chamber; and a drive signal generator which generates the drive signal for operating the pressurizing device, and causing expanding or contracting of a volume of the pressure generation chamber to eject liquid droplets through the nozzle, wherein the drive signal comprises:

an expansion pulse to expand the volume of the pressure generation chamber;

a first contraction pulse following the expansion pulse to contract the volume of the pressure generation chamber; and a second contraction pulse after the first contraction pulse to contract the volume of the pressure generation chamber, wherein a pulse width of the expansion pulse is 0.7 AL through 1.3 AL, and a pulse width of the first contraction pulse is 0.3 AL through 1.5 AL, where AL is ½ of an acoustic resonance period of the pressure generation chamber.

(2) A liquid droplet ejecting apparatus comprising:

a pressurizing device to be operated by a drive signal;

a pressure generation chamber whose volume expands or contracts by a movement of the pressurizing device;

a liquid droplet ejecting head having a nozzle communicating with the pressure generation chamber; and a drive signal generator which generates the drive signal for operating the pressurizing device, and causing expanding or contracting of a volume of the pressure generation chamber to eject liquid droplets through the nozzle, wherein the drive signal comprises:

an expansion pulse to expand the volume of the pressure generation chamber;

a first contraction pulse following the expansion pulse to contract the volume of the pressure generation chamber; and a second contraction pulse after the first contraction pulse to contract the volume of the pressure generation chamber, wherein a pulse width of the expansion pulse is 0.7 AL through 1.3 AL, and a pulse width of the first contraction pulse is 2.5 AL through 3.5 AL, where AL is ½ of an acoustic resonance period of the pressure generation chamber.

(3) The liquid droplet ejecting apparatus of (1), wherein the pulse width of the first contraction pulse in the drive signal is 0.3 AL to 1.0 AL, the time interval between the trailing edge of the expansion pulse and the leading edge of the second contraction pulse is 0.7 AL to 1.3 AL, and the time interval between the trailing edge of the first contraction pulse and the leading edge of the second contraction pulse is 0.3 AL or more.

(4) The liquid droplet ejecting apparatus of any of (1) to (3), wherein $|V_{off}|=|V_{2\,off}|$, where $V_{off}$ (V) is the drive voltage of the first contraction pulse and $V_{2\,off}$ (V) is the drive voltage of the second contraction pulse.

(5) The liquid droplet ejecting apparatus of any of (1) to (4), wherein the drive signal comprises plural groups of pulses, each of the plural groups containing the expansion pulse, the first contraction pulse, and the second contraction pulse, in an identical drive cycle to eject liquid droplets in succession.

(6) A method of driving a liquid droplet ejecting head by applying a drive signal to a pressurizing device which is operated by drive signals, causing the volume of the pressure generation chamber to expand or contract and ejecting a liquid droplet through a nozzle, wherein the drive signal comprises:

an expansion pulse to expand the volume of the pressure generation chamber;

a first contraction pulse following the expansion pulse to contract the volume of the pressure generation chamber; and a second contraction pulse after the first contraction pulse to contract the volume of the pressure generation chamber, wherein a pulse width of the expansion pulse is 0.7 AL through 1.3 AL, and a pulse width of the first contraction pulse is 0.3 AL through 1.5 AL, where AL is ½ of an acoustic resonance period of the pressure generation chamber.

(7) A method of driving a liquid droplet ejecting head by applying a drive signal to a pressurizing device which is operated by drive signals, causing the volume of the pressure generation chamber to expand or contract and ejecting a liquid droplet through a nozzle, wherein the drive signal comprises:

an expansion pulse to expand the volume of the pressure generation chamber;

a first contraction pulse following the expansion pulse to contract the volume of the pressure generation chamber; and a second contraction pulse after the first contraction pulse to contract the volume of the pressure generation chamber, wherein a pulse width of the expansion pulse is 0.7 AL through 1.3 AL, and a pulse width of the first contraction pulse is 2.5 AL through 3.5 AL, where AL is ½ of an acoustic resonance period of the pressure generation chamber.

Preferred Embodiments

For a better understanding of the present invention, a preferred embodiment is now described, purely by way of non-limiting example and with reference to the attached drawings, wherein:

FIG. 1 shows a schematic configuration of an ink jet recording apparatus to which a liquid droplet ejecting apparatus of this invention is applied. In the ink jet recording apparatus 1, recording medium P is held tightly by a pair of conveying rollers 32 of conveying mechanism 3 and conveyed in the arrow direction of Y by conveying roller 31 which is driven to rotate by conveying motor 33.

Recording head 2 is provided between conveying roller 31 and conveying roller pair 32 with the head faced to recording surface PS of recording medium P. Recording head 2 is mounted on carriage 5 which can move reciprocally along guide rails 4 (which are provided across recording medium P) in the X-X' direction (or main scanning direction) which is approximately perpendicular to the movement (subsidiary scanning direction) of recording medium P by a driving unit which is not shown in drawings with the nozzle side of the head faced to recording surface PS of recording medium P. Recording head 2 is electrically connected to drive-signal generator 100 (see FIG. 3) which contains a circuit to generate drive-signals with flexible cable 6.

Recording head 2 records a requested ink-jet image by ejecting ink droplets while moving in the X-X' direction over recording surface PS of recording medium P along the movement of carriage 5.

In FIG. 1, ink receiver 7 is provided in a standby position such as a home position of recording head 2 so that recording head 2 may discharge a little quantity of ink into ink receiver 7 while the recording head is not recording. A cap (not shown in drawings) is provided to cover the nozzle surface of recording head 2 for protection while recording head 2 stays long in this standby position. Another ink receiver 8 is provided opposite to ink receiver 7 with recording medium P between ink receivers 7 and 8. Ink receiver 8 is used to receive ink which is discharged when the recording head reverses the moving direction.

The driving method of this invention can be applied to any liquid droplet ejecting head as long as the liquid droplet ejecting head is equipped with a nozzle opening to eject liquid droplets, a pressure generation chamber which communicates with the nozzle opening, and a pressurizing device which changes the pressure in the pressure generation chamber. Further, any liquid can be filled in the pressure generation chamber. The following description uses ink jet recording head 2 of shear-mode as a liquid droplet ejecting head which is equipped with a pressurizing device to vary pressure by expanding or contracting the volume in the pressure generation chamber filled with ink.

In the shear-mode recording head, the partition wall of the pressure generation chamber are made up of piezoelectric elements which work as pressurizing devices. The piezoelectric elements are deformed to eject ink droplets through the nozzle.

Figure 2:
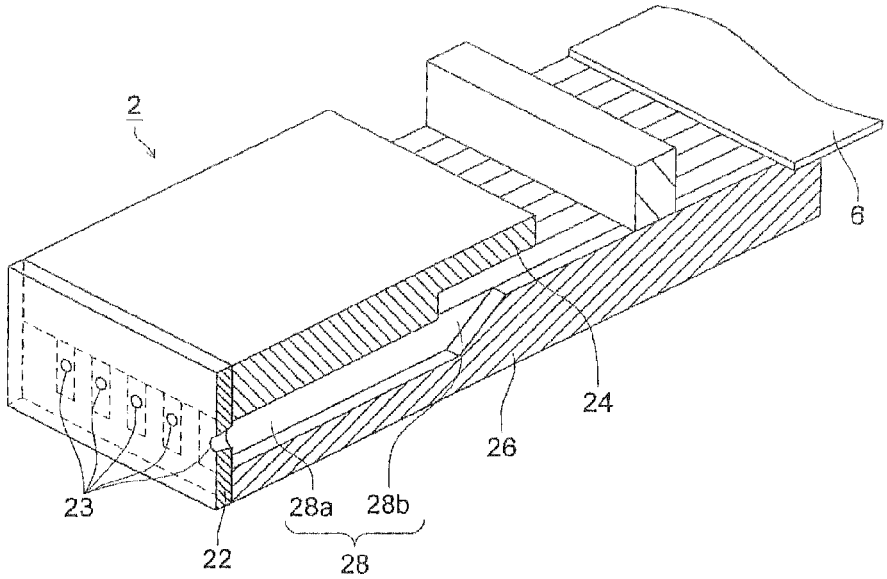
FIGS. 2(*a*) and (*b*) show a schematic configuration of a shear-mode ink jet recording apparatus which is one mode of liquid droplet ejecting head.
Figure 2:
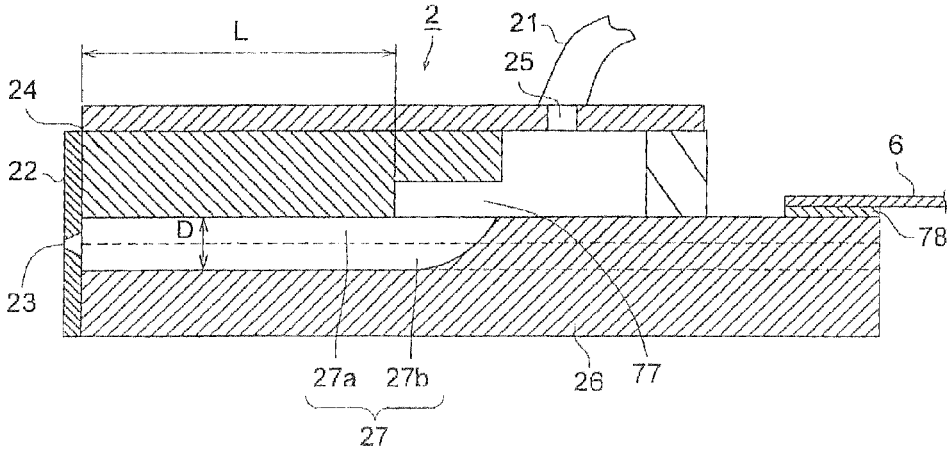

FIGS. 2(*a*), (*b*) show a schematic configuration of a shear-mode ink jet recording apparatus which is one mode of liquid droplet ejecting head. FIG. 2(*a*) is an oblique perspective Figure of a shear-mode ink jet recording apparatus which partially shows a sectional view. FIG. 2(*b*) is a sectional view of a shear-mode ink jet recording apparatus with an ink supply section.

In the following description, like parts related to the pressure generation chamber may be designated by like reference numbers throughout the several drawings since the pressure generation chambers are common in the drawings.

FIGS. 3(*a*) to (*c*) show the operations of the recording head.

Items in FIGS. 2(*a*), (*b*) and FIGS. 3(*a*) to (*c*) are drive signal generator 100, recording head 2, ink tube 21, nozzle forming member 22, nozzles 23, cover plate 24, ink supply port 25, substrate 26, partition wall 27, and length L, depth D, and width W of the pressure generation chamber. Pressure generation chamber 28 working as an ink channel is built up with partition wall 27, cover plate 24, and substrate 26.

As shown in FIGS. 3(*a*) to (*c*), recording head 2 is a shear-mode recording head which contains multiple pressure generation chambers 28 partitioned by walls 27A, 27B, 27C, and 27D made of piezoelectric material such as PZT which works as an electromechanical transducer between cover plate 24 and substrate 26. Among pressure generation chambers 28, FIG. 3 shows three pressure generation chambers (28A, 28B, and 28C). One end of pressure generation chamber 28 (sometimes called "a nozzle end") is connected to nozzles 23 which are formed in nozzle forming member 22. The other end of pressure generation chamber 28 (sometimes called "a manifold end") is connected to an ink tank (not shown in drawings) with ink tube 21 via ink supply port 25. Each surface of the partition wall 27 in each pressure generation chamber 28 has an electrode (29A, 29B, or 29C) tightly bonded to both sides. Each electrode (29A, 29B, or 29C) extends from the top of partition wall 27 to the bottom of substrate 26 and connected to drive signal generator 100.

Next will be described a method of producing recording head 2 and its constituting materials.

Recording head 2 is produced first by bonding two piezoelectric materials 27*a* and 27*b* of different directions of polarization together, bonding this piezoelectric material unit to one side of substrate 26 with a glue agent, and cutting parallel grooves of identical shape which will work as pressure generation chambers 28 in the upper piezoelectric material (27*a*) by diamond blades or the like. With this, adjacent pressure generation chambers 28 are partitioned by walls 27 which are polarized in the arrow direction. Each pressure generation chamber 28 contains a deeper section 28*a* at the exit side (left side in FIG. 2(*a*)) of the chamber and a shallow section 28*b* which becomes shallower towards the entrance side (right side in FIG. 2(*a*)) of the chamber.

Each partition wall 27 is made of two piezoelectric materials 27*a* and 27*b* of different directions of polarization as indicated by arrows in FIG. 3(*a*), but two piezoelectric materials are not always required. The piezoelectric materials may exist on at least one part of partition wall 27, for example, on item 27*a* only.

Piezoelectric materials for substrates 27*a* and 27*b* can be any well-known piezoelectric materials which can deform when a voltage is applied. The substrate can be made of organic materials, but more preferably made of non-metallic piezoelectric materials. Substrates of such non-metallic piezoelectric materials are, for example, ceramic substrates formed by processes such as molding and calcining or substrates formed by processes such as coating and laminating. Organic materials available are organic polymers and hybrid materials of organic polymer and inorganic materials.

Ceramics substrates can be made from PZT ($PbZrO_3$—$PbTiO_3$), PZT added with third components such as $Pb(Mg_{1/3}Nb_{2/3})O_3$, $Pb(Mn_{1/3}Sb_{2/3})O_3$, and $Pb(Co_{1/3}Nb_{2/3})O_3$. Further, the ceramics substrates can be formed using $BaTiO_3$, ZnO, $LiNbO_3$, and $LiTaO_3$.

The sol-gel method, laminated substrate coating method, and other methods can be used to form substrates by processes such as sol-gel process, and laminated layer coating process.

The top surface of piezoelectric material 27*a* has cover plate 24 bonded to cover deep groove sections 28*a* of all pressure generation chambers 28 with the glue agent and has ink inlet 77 (to supply ink into pressure generation chambers 28) on the shallow groove section 28*b* of each pressure generation chamber 28.

After cover plate 24 is bonded to the top surface of the piezoelectric material, one nozzle forming member 22 containing nozzles 23 is bonded with the glue agent.

Cover plate 24 and substrate 26 can be made of any materials. The substrate can be made of an organic material. From the aspect of high heat conductivity and prevention of channel-to-channel crosstalk, however, the substrate is preferably made of non-metallic non-piezoelectric material. As non-metallic non-piezoelectric materials, it is preferable to select at least one from a group of alumina, aluminum nitride, zirconia, silicone, silicone nitride, silicone carbide, silicon dioxide, and non-polarized PZT. Preferable organic materials are organic polymers and hybrid materials of organic polymer and inorganic material.

Nozzle forming member 23 can preferably be made of synthetic resins (such as polyimide resin, polyethylene terephthalate resin, liquid crystal polymer, aromatic polyamide resin, polyethylene naphthalate resin, and polysulfone resin) and metallic materials such as stainless steel.

In each pressure generation chamber 28, metallic electrode 29 is provided from each side wall to the bottom and further extends towards the rear surface of piezoelectric materials 27*a* through shallow section 28*b*. Flexible cable 6 is bonded to each of metallic electrodes 29 on the rear surface by means of anisotropic electro conductive film 78. When a drive signal is applied to each metallic electrode 29 from drive-signal generator 100, side wall 27 shear-deforms. Ink is ejected from pressure generation chamber 28 through nozzle 23 of nozzle plate 22 by a pressure caused by the shear-deformation.

Preferable metals for metallic electrodes 29 are platinum, gold, silver, copper, aluminum, palladium, nickel, tantalum, and titanium. Particularly, gold, aluminum, copper, and nickel are more preferable from the aspect of electric characteristics and workability. Metallic electrodes 29 are formed by plating, vapor deposition, or spattering.

As described above, the major part of shear-mode recording head 2 can be formed just by cutting pressure generation chambers 28 in piezoelectric materials 27*a* and 27*b* and forming metallic electrodes 29 on side walls 27 of each pressure generation chamber. This is a preferable mode to accomplish high-fineness recording since the recording head can be produced easily and have a lot of pressure generation chambers 28 very densely.

Next will be described how ink droplets are ejected.

When a drive signal is applied from drive signal generator 100 to electrodes 29A, 29B, and 29C which are respectively formed tightly on partition wall 27 surfaces, ink droplets are ejected through nozzles 23 by actions described below with examples. Nozzles are not shown in FIG. 3(*a*)-FIG. 3(*c*).

As described above, this recording head 2 applies positive and negative pressures to ink in pressure generation chamber 28 by deformation of partition walls 27. Partition walls 27 constitute a pressurizing device.

A Method of Driving the Preferred Embodiment

FIG. 4(*a*) shows a drive signal to realize a method of driving the preferred embodiment in accordance with the present invention and pressures to be applied by a drive signal to ink in pressure generation chamber 28. FIG. 4(*b*) shows a behavior of an ink meniscus in a nozzle and ejection of a liquid droplet by the driving method of the preferred of this invention. In FIGS. 4(*a*) and (*b*), like time points are designated by like reference numbers in parentheses.

In FIG. 4(*a*), the horizontal axis is expressed in AL times and the vertical axis is expressed in relative drive voltages and in relative pressures. L1 and dotted lines are for drive signals. L2 and solid lines are for pressures.

In FIG. 4(*b*), ink pillars, ink droplets, and meniscuses are respectively expressed by 102, 101, and M in this order.

In this specification, "ink pillar" is defined as part of ink whose top protrudes from the opening of nozzle 23 but the bottom is still attached to meniscus M and not separated from meniscus M. "Ink droplet" is defined as part of ink whose bottom is completely separated from the meniscus in nozzle 23.

(1) When recording head 2 is in the status of FIG. 3(*a*), electrodes 29A and 29C are connected to earth and an expansion pulse (of positive voltage) which is a rectangular wave is applied to electrode 29B. The first rise (P1) in the leading edge of the expansion pulse causes an electric field perpendicular to the direction of polarization of piezoelectric materials 27*a* and 27*b* which constitute partition walls 27B and 27C. This causes a shearing deformation in the joint of partition walls of piezoelectric materials 27*a* and 27*b*. Consequently, as shown in FIG. 3(*b*) partition walls 27B and 27C deform outwards to increase the volume of pressure generation chamber 28B and generate a negative pressure in pressure generation chamber 28B. As the result, ink is drawn into the chamber (called a drawing step).

As already explained, "AL" (short for Acoustic Length) is ½ of the acoustic resonance cycle of the pressure generation chamber. AL can be obtained as a pulse width which maximizes the ejecting velocity of ink droplets when the pulse widths of rectangular pulses are varied with the rectangular pulse voltage kept constant in measurement of the ejecting velocities of ink droplets which are ejected by applying rectangular pulses to partition wall 27 which is an electromechanical transducer. The AL (in μs) of recording head 2 of this Embodiment is 2.4, but it is dependent upon head structures and ink densities, and so on.

A pulse is a rectangular wave of a constant amplitude (pulse-height voltage). A pulse width (or duration) is defined as the interval between the 10% point in the rise (or fall) from the starting voltage (0V as 0%) and the 10% point in the fall (or rise) from the pulse-height voltage (as 100%). Further, a rectangular wave means a waveform whose rise and fall times between 10% and 90% points of the voltage are within ½ of AL and preferably within ¼.

(2) The pressure wave inverts every one AL time in pressure generation chamber 28B. When the potential is returned to 0 one AL time later after the first P1 application (assuming that the P2 application ends at the trailing edge of the expansion pulse), partition walls 27B and 27C return from the expansion position to the neutral positions (see FIG. 3(*a*)). This will give a high pressure to ink in pressure generation chamber 28B.

Then, a first contraction pulse (negative voltage) which is a rectangular wave is applied. At the fall (P3) in the leading edge of the pulse, partition walls 27B and 27C deforms inwards (to draw closer) as shown in FIG. 3(*c*) and consequently, pressure generation chamber 28B reduces the volume. This contraction gives a higher pressure to ink in pressure generation chamber 28B (called a reinforcing step). As the result, ink pillar 102 comes out through the opening of nozzle 23.

(2.5) 0.5 AL time later, the pressure wave in pressure generation chamber 28B inverts into a negative pressure. At this time point, the potential is returned to 0 (assuming that the P4 application ends at the trailing edge of the first contraction pulse). When partition walls 27B and 27C return from the contraction positions to the neutral positions, the volume of pressure generation chamber 28B increases and a negative pressure is applied to ink in pressure generation chamber 28B. By this negative pressure, meniscus M is drawn back and the trailing edge of projected ink pillar 102 is also drawn back. As the result, the diameter of the ink pillar becomes smaller and the ink pillar is hard to be longer. In this case, since the phase of a pressure wave caused by a negative pressure by this expansion is the same as the phase of the pressure wave caused by the negative pressure due to inversion, the pressure waves overlap with each other and become stronger. As the result, a pressure wave of greater amplitude generates in pressure generation chamber 28B.

(3) 0.5 AL time later, the negative pressure in ink becomes greatest and ink pillar 102 has a constriction on its root as shown with the arrow in FIG. 4(*b*). At this time point, a second contraction pulse (negative voltage) of a rectangular wave is applied. First, at the fall (P5) in the leading edge of the pulse, partition walls 27B and 27C deforms outwards (to part from each other) and the volume of pressure generation chamber 28B reduces. In this case, the pressure wave caused by a positive pressure by this contraction cancels the pressure wave caused by the negative pressure and the pressure wave is weakened.

(5) Further 1 AL time later, the positive pressure becomes the greatest. At this time point, the potential is returned to 0 (assuming that the P6 application ends at the trailing edge of the second contraction pulse). When partition walls 27B and 27C return from the contraction positions to the neutral positions, the volume of pressure generation chamber 28B increases and a negative pressure is applied to ink in pressure generation chamber 28B. In this case, the pressure wave caused by a negative pressure by this expansion cancels the pressure wave caused by the positive pressure. As the result, the pressure wave is weakened and substantially disappears.

(6.5) 3.5 AL time later after a high pressure is applied to ink in (2), ink pillar 102 projecting from the opening of nozzle 23 is detached from meniscus M and flies as liquid droplet 101.

The above driving method is called a DRRC (Draw-Release-Reinforce-Cancel) driving method. The pulse width of an expansion pulse greatly affects the ejection force of an ink droplet. When the pulse width is equal to 1 AL, the droplet ejection force (ejection velocity) becomes the greatest. The first contraction pulse is applied at the fall (P2) of the expansion pulse, which is to say, 1 AL later. Therefore, when the pulse width of the expansion pulse is set to 1 AL as explained above, a negative pressure wave which generated at the rise (P1) of the expansion pulse is propagated in the pressure generation chamber and inverted into a positive pressure wave. At the same time, to this positive pressure wave are added positive pressure waves that were generated by contractions of the pressure generation chamber at the fall (P2) of the expansion pulse and at the fall (P3) of the first contraction pulse. This makes the ejection force most efficient. This can reduce the drive voltage and save the power consumption of the pressurizing device.

Since the pulse width of the first contraction pulse is 0.5 AL, when the potential is returned to 0 after the first contraction pulse is applied, the pressure generation chamber expands. A pressure wave of a negative pressure caused by this expansion is overlapped with a pressure wave of a negative pressure caused at the leading edges of the expansion pulse and the first contraction pulse and inversed. This enhances the negative pressure waves into a strong negative pressure wave in pressure generation chamber 28B. This strong negative pressure wave pulls back the meniscus, makes the ink pillar thinner, detaches ink pillar 102 from meniscus M earlier (before the ink pillar becomes longer), and lets the ink pillar fly freely. Further, this can suppress breakup of main and satellite droplets and reduce the number of satellites.

Although this embodiment uses 0.5 AL as the pulse width of the first contraction pulse, the pulse width can be in the range of 0.3 to 1.5 AL or 2.5 to 3.5 AL. With this pulse width setting, the pressure wave of a negative pressure caused at the trailing edge of this contraction pulse can be enhanced by the pressure waves which generated at the leading edges of the expansion pulse and first contraction pulse. Consequently, the satellites can be reduced. Particularly, when the pulse width of the first contraction pulse is 0.3 to 1.5 AL, a great negative pressure can be generated earlier at the end (P4) of application of the first contraction pulse. As the result, ink pillar 102 can detach from meniscus M earlier before the ink pillar becomes longer, and fly freely. This can reduce the number of satellites.

When the pulse width of the first contraction pulse is shorter than 0.3 AL (which is considerably smaller than AL), the droplet ejecting force becomes smaller and the driving efficiency goes down (which increases the drive voltage). Further when the pulse width of the first contraction pulse is made longer than 3.5 AL, the effect to draw back the meniscus earlier is not available. Accordingly, the effect to reduce the number of satellites goes down.

Although the above embodiment uses 1 AL as the pulse width of the expansion pulse, it can be in the range of 0.7 to 1.3 AL. When the pulse width of the expansion pulse goes out of this range, the ejection efficiency of the pressure waves will go down and the drive voltage goes up greatly.

Further, since the time interval between the trailing edge of an expansion pulse and the leading edge of a second contraction pulse is 1 AL, a positive pressure wave due to the leading edge of the second contraction pulse is added when positive pressure waves (caused at the trailing edge of the expansion pulse and the leading edge of the first contraction pulse) are inverted into a negative pressure after 1 AL. This increases the effect to cancel the pressure wave and enables high-frequency driving. The time interval between the trailing edge of the expansion pulse and the leading edge of the second contraction pulse can be 0.7 to 1.3 AL which is approximately 1 AL, but a time interval of 1 AL is most preferable.

It is possible to set the time interval between the trailing edge of the expansion pulse and the leading edge of the second contraction pulse to 0.7 to 1.3 AL which is about 1 AL by setting the pulse width of the first contraction pulse in the range of 0.3 to 1.0 AL. Further, it is possible to enhance the effect to reduce satellites and the cancellation effect by the second contraction pulse by setting the time interval between the trailing edge of the first contraction pulse and the leading edge of the second contraction pulse to 0.3 AL or more. To further enhance the cancellation effect by the second contraction pulse, it is preferable to set 1.0 AL or less as the time interval between the trailing edge of the first contraction pulse and the leading edge of the second contraction pulse.

The pulse width of the second contraction pulse is preferably 0.7 to 1.3 AL which is approximately 1 AL and more preferably 1 AL as in the above embodiment. This is because the cancellation effect is enhanced by a negative pressure wave caused at the trailing edge of the second contraction pulse.

Since the drive signal of FIG. 4(*a*) satisfies |Voff|=|V2 off| (where Voff (V) is the drive voltage of the first contraction pulse and V2 off (V) is the drive voltage of the second contraction pulse), both first and second pulses can be generated by a single power supply. This can reduce the cost of power supply.

Further, this example uses |Von|/|Voff|=1/0.7 where Von (V) is the drive voltage of the expansion pulse and Voff (V) is the drive voltage of the first contraction pulse. When |Von| is greater than |Voff| as in this example, ink is effectively supplied into the pressure generation chamber. This relationship is preferable when ejecting high viscosity ink at a high-frequency.

Voltages Von and Voff are not always relative to 0V (as reference voltage). In other words, these voltages Von and Voff are differential voltages.

As explained above, ink droplets are ejected to form an image. To form a gradation image or high-density image in detail, multiple drive pulse sets (an expansion pulse, first contraction pulse, and a second contraction pulse per set) are applied to the pressurizing device in an identical pixel cycle (in an identical drive cycle) according to print data to eject multiple ink droplets. These ink droplets are combined (into a dot) before they reach recording paper (that is, during flight) or after they reach recording paper. In other words, one pixel (dot) is formed when the ink droplets land on recording paper. A high-quality image can be formed with gradation or high-density pixels which are padded with enlarged dots or formed by multiple ink droplets.

In this specification, when multiple ink droplets are combined (coalesced) into a large droplet and form one pixel, each ink droplet to be combined is termed a sub-droplet SD and a combined large droplet is termed a super droplet.

To combine multiple sub-droplets SD during flight or at the time of landing into a super droplet (as a dot), the velocity of second sub-droplet SD2 must be basically faster than the first sub-droplet SD1. If not, sub-droplets SD cannot combine into a super droplet. Therefore, the velocities of sub-droplets SD3, SD4, . . . , SDn must be faster than those ejected before them.

For this purpose, the pressure wave at each SD ejection must be canceled adequately. If cancellation is insufficient, SD velocities fluctuate from each other and multiple SDs (ink droplets) to form one pixel land off the target. As the result, the pixel is blurred. Further, the meniscus changes positions in every ejection cycle and droplets cannot be ejected steadily. Contrarily, the driving method of this invention can cancel pressure waves almost completely and form super droplets steadily without causing the above problems.

(A Driving Method of a Prior Art)

For comparison, below will be explained an example to which a driving method of a prior art is applied.

FIG. 5(*a*) shows a drive signal to realize a conventional driving method and how a drive signal gives a pressure to ink in pressure generation chamber 28.

FIG. 5(*b*) shows a behavior of an ink meniscus in a nozzle and ejection of a liquid droplet by the driving method. In FIGS. 5(*a*) and (*b*), like time points are designated by like reference numbers in parentheses.

In FIG. 5(*a*), the horizontal axis is expressed in AL times and the vertical axis is expressed in relative drive voltages and in relative pressures. L1 and dotted lines are for drive signals. L2 and solid lines are for pressures.

In FIG. 5(*b*), items 11, 12, and SL respectively mean a main droplet, satellite droplets, and satellite length in this order.

(1) When recording head 2 is in the status of FIG. 3(*a*), electrodes 29A and 29C are connected to earth and an expansion pulse (of positive voltage) is applied to electrode 29B. The first rise (P1) in the leading edge of the expansion pulse causes an electric field perpendicular to the direction of polarization of piezoelectric materials 27*a* and 27*b* which constitute partition walls 27B and 27C. This causes a shearing deformation in the joint of partition walls of piezoelectric materials 27*a* and 27*b*. Consequently, as shown in FIG. 3(*b*) partition walls 27B and 27C deform outwards to increase the volume of pressure generation chamber 28B and generate a negative pressure in pressure generation chamber 28B. As the result, ink is drawn into the chamber.

(2) The pressure wave inverts every one AL time in pressure generation chamber 28B. When the potential is returned to 0 one AL time later after the first P1 application, partition walls 27B and 27C return from the expansion position to the neutral position (see FIG. 3(*a*)). This will give a high pressure to ink in pressure generation chamber 28B. This contraction applies higher pressure to ink and causes ink pillar 102 to project from the opening of nozzle 23.

(3) 1 AL time later, the negative pressure on ink becomes greatest and ink pillar 102 has a constriction on its root as shown with the arrow in FIG. 5(*b*). At this time point, a cancellation pulses (of a negative voltage whose absolute value is ½ of the positive voltage of the ejection pulse) is applied. First, at the fall (P3) in the leading edge of the pulse, partition walls 27B and 27C deforms outwards (to part from each other) and the volume of pressure generation chamber 28B reduces as shown in FIG. 3(*c*). The pressure wave of a positive pressure by this contraction cancels the above negative pressure wave since their phases are shifted by 180°. With this, the pressure waves are attenuated in an early stage. At this time, ink pillar 102 is not separated from meniscus M.

(5) Further 1 AL time later, the pressure wave is inverted to have a positive pressure. The potential is returned to 0 (P4) and partition walls 27B and 27C are returned from the contraction position to the neutral position. With this, the volume of pressure generation chamber 28B increases and meniscus M is drawn back. As the result, trailing edge of ink pillar 102 is pulled back. The pressure wave of a negative pressure caused by this expansion cancels the above positive pressure wave since their phases are shifted by 180 degrees and their amplitudes are approximately equal. As the result, the pressure wave is weakened and substantially disappears. At this time point, ink pillar 102 is not separated from meniscus M.

(6), (7) Then, ink pillar 102 keeps on being longer almost without being affected by a meniscus vibration due to a pressure wave.

(8) Owing to the surface tension of ink, ink pillar 102 detaches by itself from meniscus M and flies as ink droplets 101 with a long tail.

(9), (10) Ink droplet 101 breaks into main droplet 11 and satellite droplets 12.

Since the conventional driving method does not have an effect to draw back meniscus in the early stage, ink pillar 102 is detached from meniscus M almost without vibration in the meniscus by the pressure wave. Therefore, it takes a lot of time for the ink pillar to be detached from meniscus M. As the result, ink pillar 102 becomes longer and the number of satellites increases. SL in FIG. 5 indicates "satellite length" and the number of satellites increases as the SL value increases.

Next will be explained a time-division driving method which is an example of driving method related to embodiments of this invention.

In the case of driving recording head 2 containing multiple pressure generation chambers 28 which are partitioned by partition walls 27 each of which is partially made of piezoelectric materials, when one of pressure generation chambers 28 works to eject ink, the neighboring pressure generation chambers 28 are affected. To prevent this, the multiple pressure generation chambers 28 are usually grouped into two or more groups, each of the groups including pairs of pressure generation chambers sandwiching one or more pressure generation chambers of the other group. These pressure generation chamber groups are controlled in sequence to eject ink in a time-division manner. For example, a 3-cycle driving method divides all pressure generation chambers 28 every two chambers and controls the groups to eject ink in three phases.

Figure 7:
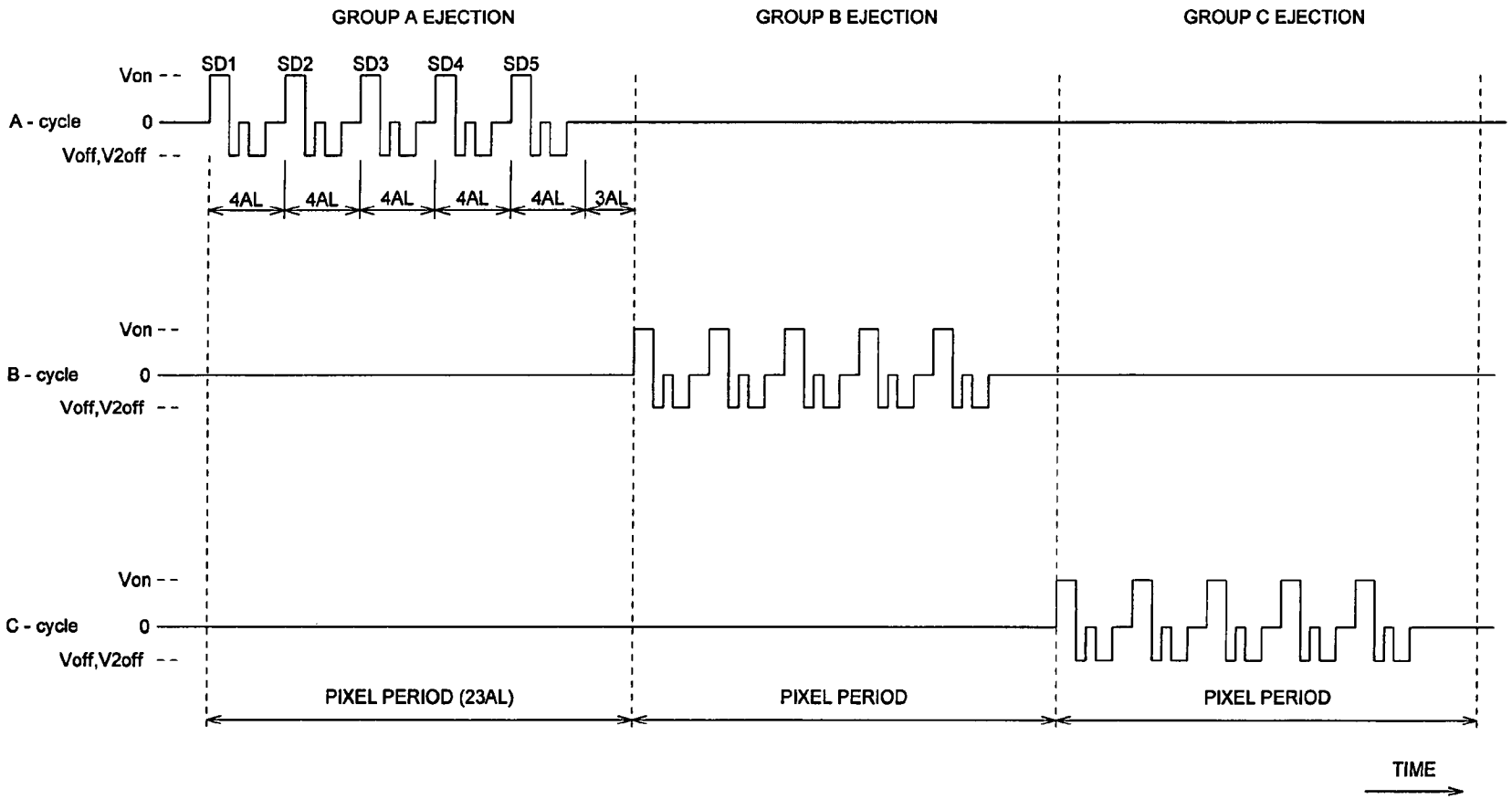
FIG. 7 shows a timing diagram of drive signals to be applied to electrodes of pressure generation chambers of each group (A, B, and C).

The 3-cycle ejection operation will be further explained referring to FIG. 6(*a*) to (*c*) assuming that the recording head contains nine pressure generation chambers 28 (A1, B1, C1, A2, B2, C2, A3, B3, and C3) and five ink droplets are ejected in one pixel cycle. FIG. 7 shows a timing diagram of drive signals to be applied to electrodes of pressure generation chambers of each group (A, B, and C). This example ejects five sub-droplets in an identical pixel cycle (or in an identical drive cycle) on the basis of drive signals of FIG. 4(*a*). To eject sub-droplet SD1, a drive signal is applied which contains an expansion pulse of 1 AL as the pulse width, a first contraction pulse of 0.5 AL, a voltage-zero break of 0.5 AL as the duration, a second contraction pulse of 1 AL, and a voltage-zero break of 1 AL as the duration. Drive signals of the similar configuration are used to respectively eject sub-droplets SD2 to SD5. The drive signal cycle for each sub-droplet is 4 AL as shown in the drawing. Further a voltage-zero break of 3 AL as the duration is added to the end of SD5. Therefore, a total time period of 23 AL is required to form a super droplet by 5 droplets (SD1 to SD5).

By using drive pulses shown in FIG. 7 to form and eject a super droplet, sub-droplets SD1 to SD5 can be combined steadily during flight or at the time of landing on a recording medium.

An operation to eject sub-droplets SD1 to SD5 through nozzles of group A (A1, A2, A3) contains steps of applying a series of drive-pulse voltages to eject SD1 to SD5 to electrodes of respective pressure generation chambers 28 of group A (A1, A2, and A3), and grounding the electrodes of the neighboring pressure generation chambers.

Similarly, pressure generation chambers 28 of group B (B1, B2, and B3) and group C (C1, C2, and C3) are operated in sequence.

The above operations are to form a solid image (by full-driving). However, actually, the numbers of ink droplets for SD1 to SD5 are changed according to print data of each pixel.

Figure 8:
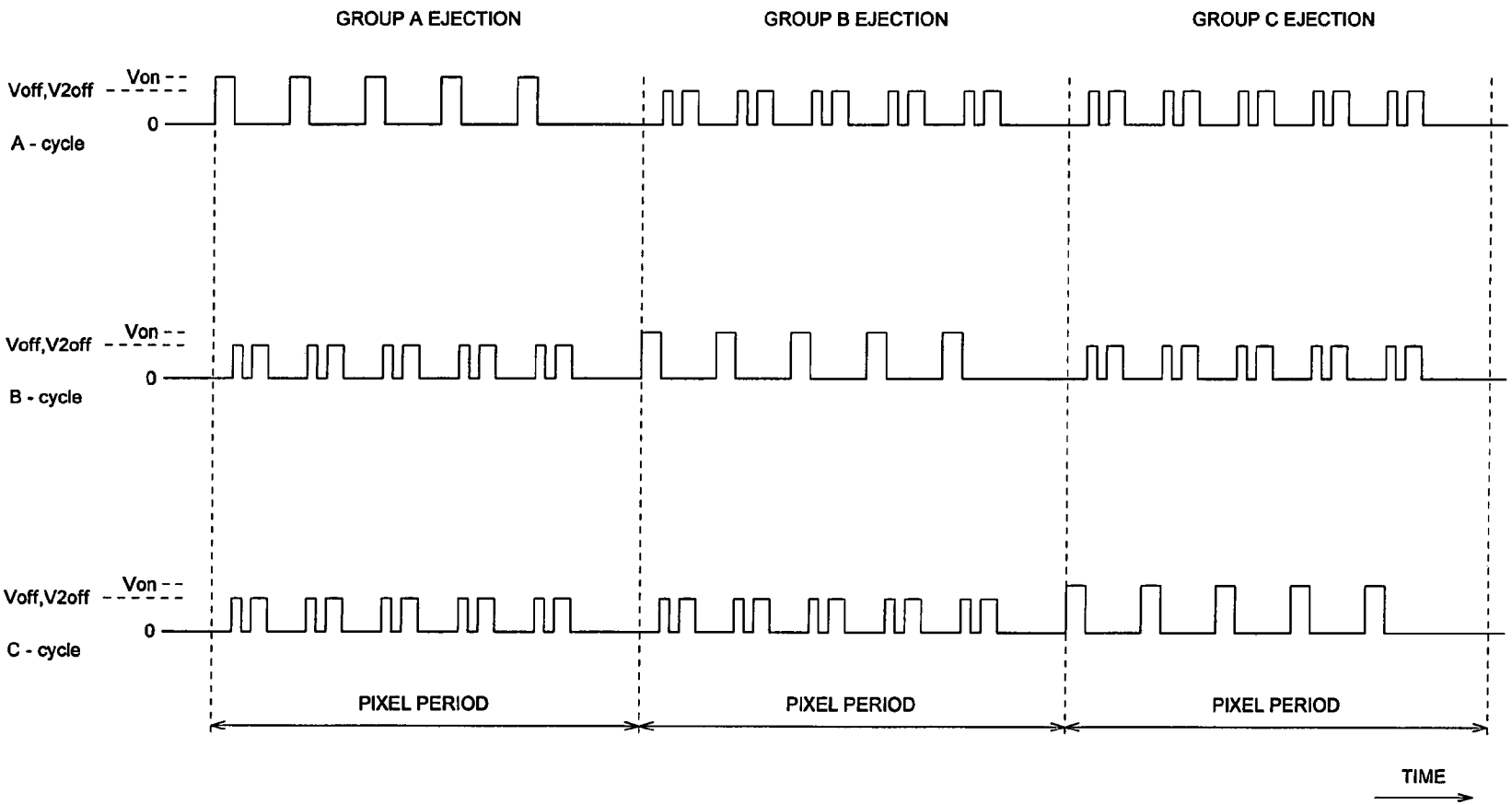
FIG. 8 shows a timing diagram of drive signals using positive voltages only.

The above shear-mode ink jet recording head deforms partition walls 27 by the difference of voltages applied to electrodes provided on both sides of each partition wall. Therefore, instead of applying a negative voltage to the electrode of a pressure generation chamber to eject ink, the similar operation can be obtained by grounding the electrode of a pressure generation chamber to eject ink and applying a positive voltage to electrodes of the neighboring pressure generation chambers as shown in FIG. 8. The latter driving method is preferable judging from reduction of a power cost since the method uses only positive voltages to drive.

By the way, the driving method works on remarkably when the viscosity of ink to be ejected is 5 cp or more but not exceeding 15 cp at the ejection temperature. Such ink is high in viscosity and fluid resistance and ink pillars are hard to be separated from the meniscus. As a matter of course, the ink pillar is apt to go longer and generate satellites.

If the viscosity of ink is too high, it is impossible to eject ink through a nozzle smoothly. Further, a high drive voltage is required to eject such viscous ink. Therefore, the ink viscosity is preferably 15 cp or less.

The present inventors used Oscillating Viscometer Model VM-1A-L (manufactured by Yamaichi Electronics Co., Ltd.) for viscosity measurement and Densimeter Model DA-110 (Kyoto Electronics Co., Ltd.) for density measurement. The inventors calculated ink viscosity by dividing the readout of the oscillating viscometer by the measured density.

The driving method works on remarkably when the surface tension of ink to be ejected is 20 dyne/cm or more but not exceeding 30 dyne/cm at 25° C. This is because ink pillars of such a low surface tension are hard to be separated from meniscuses and apt to generate satellites.

Further, when the surface tension of ink becomes lower, its wettability to nozzle forming member 22 goes higher and ink is apt to deposit around nozzle 23 on the ejection side of the nozzle plate ejection. Any crud in the vicinity of nozzle 23 on the outer side of the nozzle forming member will interfere with the ejection of ink, causing the ejected ink to change its flight. To prevent this, the surface tension of ink is preferably 20 dyne/cm or more.

The present inventors used Surface Tension Balance CBVP A-3 type (Kyowa Science Co., Ltd.) for measurement of surface tensions of ink.

The oil-based ink and the UV hardening ink are representative as such kinds of ink. The oil-based ink contains, as the solvent, 80% or more by mass of saturated hydrocarbon of 15 to 18 carbon atoms (per molecule), univalent alcohol of 15 to 18 carbon atoms per molecule, or their derivatives. The oil-based ink can offer high waterproof images.

As the UV hardening ink, it is possible to use cationic polymeric ink or radical polymeric ink independently and further it is possible to mix these kinds of ink and use the mixture as hybrid ink.

The UV hardening ink should preferably contain, as the constituent substances, the following epoxy compounds, epoxidized oil, oxetane compounds, aprotic solvent, radical polymeric monomer, color materials, and other additives.

Epoxy compounds, epoxidized oil, and oxetane compounds are available as the cationic polymeric compounds.

Radical polymeric monomers are available as the radical polymeric compounds. Further, as the radical polymeric monomers available are various kinds of (meth-)acrylate monomers, for example, monofunctional monomers such as isoamyl acrylate, stearyl acrylate, lauryl acrylate, octyl acrylate, decyl acrylate, isomylstyl acrylate, isostearyl acrylate, 2-ethylhexyl-diglycol acrylate, 2-hydroxybutyl acrylate, 2-acryloyl-oxyethyl hexahydrophthalate, butoxyethylacrylate, ethoxydiethylene glycol acrylate, methoxydiethylene glycol acrylate, methoxypolyethylene glycol acrylate, methoxypropylene glycol acrylate, phenoxyethyl acrylate, tetrahydrofurfuryl acrylate, isobornyl acrylate, 2-hydroxyethyl acrylate, 2-hydroxypropyl acrylate, 2-hydroxy-3-phenoxypropyl acrylate, 2-acryloyl-oxyethyl succinate, 2-acryloyl-oxyethyl phthalate, 2-acryloyl-oxyethyl-2-hydroxyethyl phthalate, lactone denatured flexible acrylate, and t-butyl-cyclohexyl acrylate;

bifunctional monomers such as triethylene glycol diacrylate, tetraethylene glycol diacrylate, polyethylene glycol diacrylate, tripropyleneglycol diacrylate, polypropylene glycol diacrylate, 1,4-butanedioldiacrylate, 1,6-hexandioldiacrylate, 1,9-nonandioldiacrylate, neopentylglycol diacrylate, dimethylol-tricyclodecane diacrylate, diacrylate of EO adduct of bisphenol A, diacrylate of PO adduct of bisphenol A, hydroxy-pivalic-neopentyl glycol diacrylate, and polytetramethylene glycol diacrylate; and multifunctional monomers (tri- or higher functional-monomers) such as trimethylol propane triacrylate, EO denatured trimethylol propane triacrylate, pentaerythritol triacrylate, pentaerythritol tetraacrylate, dipentaerythritol hexaacrylate, ditrimethylol propane tetraacrylate, glycerinepropoxy triacrylate, caprolactone denatured trimethylol propane triacrylate, pentaerythritolethoxy tetraacrylate, and caprolactam denatured dipentaerythritol hexaacrylate.

When an image recorded in UV hardening ink is exposed to UV light, the UV hardening ink of the image is hardened and the image can be retained steadily for a long time. This can increase the quality of ink-jet images. Further, the UV hardening ink enables image recording not only on high ink-absorbent recording media (e.g. paper) but also on non- or low-ink-absorbent recording media.

Particularly, it is necessary to suppress generation of satellites of the UV hardening ink because the ink satellites deposited near nozzles are hardened by a leaking UV light and cannot be removed easily.

The above embodiment has the pressurizing devices (partition wall S) made up with piezoelectric elements. The driving method of this invention is preferable because the volumes of pressure generation chambers in such a configuration can be controlled easily.

Further, the above embodiment uses rectangular drive pulses whose rise and fall times are sufficiently shorter than AL to apply to piezoelectric elements. With this, the driving method can use the acoustic resonance of pressure waves more effectively. In comparison with a driving method which uses trapezoidal waves, this method using rectangular waves has a high droplet ejection efficiency and uses lower driving voltages. Further, this method can be accomplished by a simple digital drive circuit. Further, this method has an advantage of easy pulse width setting.

Further, the above embodiment uses, for the pressurizing device, shear-mode piezoelectric elements which deform in a shearing mode when an electric field is applied to the devices. The shear-mode piezoelectric elements are preferable since the driving method can use rectangular drive pulses more effectively and drive more efficiently at lower driving voltages. In the above description, the recording head contains a series of ink channels (working as pressure generation chambers) which are individually separated by partition walls. However, the driving method of this invention can be applied to a dummy channel type recording head in which ink channels and dummy channels are alternately disposed and ink channels are disposed every other channel to eject ink from the ink channels. In this configuration, the ink channel can be driven easily because the partition walls of the ink channel can shear-deform without giving any influence on the neighboring ink channels at both sides of the ink channel.

Further, this shear-mode head has ink channels (as ink grooves) formed in piezoelectric elements. When the piezoelectric element is heated for driving, the heat is transferred to ink and the temperature of ink rises. This reduces the viscosity of the ink. As the result, ink droplets eject faster and land off the target position. This greatly deteriorates the image quality. As explained below by another embodiment of this invention, the driving method of this invention uses lower driving voltages than the driving method of the prior art. Consequently, this method can reduce both power consumption and the quantity of heat generation. This can reduce a velocity change due to a rise of ink temperature.

This invention is not limited to the above configurations. For example, the piezoelectric elements can be those of the other mode such as single-plate type piezoelectric actuators and axial vibration type laminated piezoelectric elements. Similarly, the other pressurizing devices can be used such as electromechanical transducer elements which use electrostatic or magnetic forces and electro-thermo transducer elements which use the boiling phenomenon.

Further, the above description shows an application example of an ink jet recording apparatus as a liquid droplet ejecting apparatus and uses an ink jet recording head as a liquid droplet ejecting head to record images. However, this invention is not limited to these. This invention is widely applicable to a liquid droplet ejecting apparatus equipped with nozzles to eject liquid droplets, pressure generation chambers which communicate with the nozzles, and pressurizing devices to change pressures in the pressure generation chambers and a method of driving a liquid droplet ejecting head. Particularly, this invention is effective in industrial fields which require high-definition printing without satellite contamination such as preparation of color filters for liquid crystal displays.

EXAMPLES

Examples 1 to 8

The present inventors prepared a high-density recording head (360-dpi recording head) by bonding two shear-mode recording heads of FIG. 2 (nozzles pitch of 180 dpi, 256 nozzles per head, 23 μm in nozzle diameter, AL of 2.4 μs, and ink droplet of 4 picoliters) with their nozzle rows shifted by ½ pitch so that nozzles of two heads may be disposed at 360-dpi in a zig-zag manner.

We drove this 2-row head (512 nozzles spaced at 360 dpi) in 3 cycles by dividing channels of each row into three groups, and applying a drive signal (the basic drive signal containing a 1-AL expansion pulse, a 0.5-AL first contraction pulse, and a 1-AL second contraction pulse) to eject five sub-droplets SD1 to SD5.

The present inventors used acrylic UV hardening ink and heated the ink to 50° C. by a heater to eject ink droplets.

The inventors changed the pulse width of the first contraction pulse of the drive signal in 8 ways under the condition of $|Von|/|Voff|=1/0.7$ (where Von is the drive voltage of the expansion pulse and Voff is the drive voltage of the first contraction pulse) and 1 AL as the pulse width of the expansion pulse.

(Condition)

Ink: Acrylic UV hardening ink (viscosity of 10 cp (measured at 50° C.) and surface tension of 28 dyne/cm (measured at 25° C.))

Pulse widths of the first contraction pulse:

0.3 AL (Example 1)
0.5 AL (Example 2)
1.0 AL (Example 3)
1.25 AL (Example 4)
1.5 AL (Example 5)
2.5 AL (Example 6)
3.0 AL (Example 7)
3.5 AL (Example 8)

The inventors evaluated the relationship between ejecting velocities of ink droplets and satellite lengths and relationship between drive voltages (Von) and ejecting velocities of ink droplets of any one nozzle by the following method while changing the drive voltages (Von and Voff) (with |Von|/|Voff| fixed to 1/0.7).

Measurement of ejecting velocities and satellite lengths:

The inventors stroboscopically shot first sub-droplet SD1 by the CCD camera when it flew about 1 mm away from the nozzle opening and measured the velocity of the ink droplet and the length SL of the satellite. As the SL becomes greater, the quantity of satellite increases.

Measurement of ejecting velocities and drive voltages: The inventors stroboscopically shot first and fifth sub-droplets SD1 and SD5 respectively by the CCD camera when respective sub-droplets flew about 1 mm away from the nozzle opening and measured the velocity of each droplet and the length SL of the satellite under the condition of 0.5 AL as the pulse width of the first contraction pulse (Example 2).

Measurement of changes in droplet velocity by heat generated during driving:

The inventors drove two rows of head fully (for solid printing) at a drive frequency of 25.5 KHz (to eject SD1 at 6 m/s) and measured the relationship between driving periods and droplet velocity changes (rise). Electric power was controlled to keep the initial temperature of the heater at 50° C. The heater was not feedback-controlled after driving started. When the temperature of ink goes up by the driving heat, the viscosity of the ink goes down and the velocity of droplets increases. Therefore, a low velocity change means that the power consumption of drive pulses is little and the heat generation is suppressed.

For this recording head, the optimum velocities of sub-droplets SD1 and SD5 are respectively 6 m/s (SD1) and 7 m/s (SD5) to make SD1 and SD5 land on the same point under the condition of 4 AL as the SD cycle and 2 mm as the gap between the recording medium and the nozzle.

Comparative Example 1

Comparative Example 1 is the same as the Example but each of drive pulses SD1 to SD5 in FIG. 7 is substituted by a drive pulse of the prior art in FIG. 5(*a*).

Comparative Examples 2 to 5

Comparative Examples 2 to 5 are respectively the same as the Examples but the pulse width of the first contraction pulse is changed as follows:

Pulse widths of the first contraction pulse:

0.1 AL (Comparative Example 2)
1.6 AL (Comparative Example 3)
2.0 AL (Comparative Example 4)
2.4 AL (Comparative Example 5)

Figure 9:
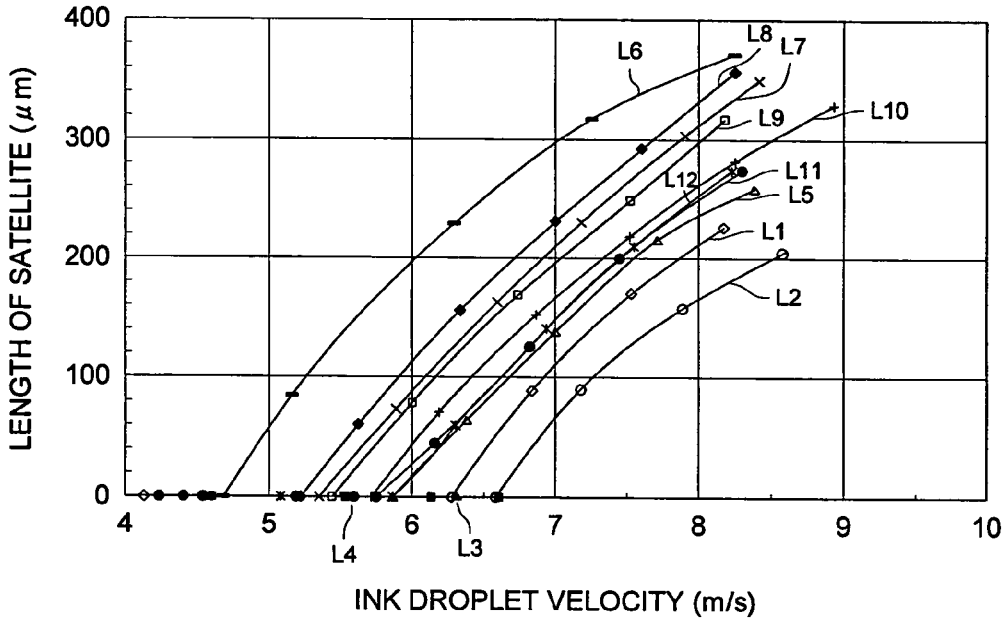
FIG. 9 is a graph of experimental data showing relationships between velocities of ink droplets and satellite lengths in accordance with the driving method of this invention.

FIG. 9 shows the relationship between droplet velocities and satellite lengths when only sub-droplets SD1 in Example and Comparative Examples is ejected. Comparative Example 2 is excluded since the ink droplets are very slow and unstable.

In FIG. 9, the horizontal axis represents the velocity (m/s) of ink droplets and the vertical axis represents the length (μm) of satellites. In FIG. 9, points plotted by symbol "◇" and line L1 are for Example 1.

Plotted points "○" and line L2 are for Example 2.
Plotted points "▲" and line L3 are for Example 3.
Plotted points "■" and line L4 are for Example 4.
Plotted points "Δ" and line L5 are for Example 5.
Plotted points "–" and line L6 are for Comparative Example 1.
Plotted points "×" and line L7 are for Comparative Example 3.
Plotted points "◆" and line L8 are for Comparative Example 4.
Plotted points "□" and line L9 are for Comparative Example 5.
Plotted points "+" and line L10 are for Example 6.
Plotted points "●" and line L11 are for Example 7.
Plotted points "*" and line L12 are for Example 8.

As shown in FIG. 9, satellites formed by the driving methods of Examples are much shorter than those formed by the driving methods of Comparative Examples. Judging from this, the inventors confirm that the driving method of this invention is effective to reduce the quantity of satellites.

Figure 10:
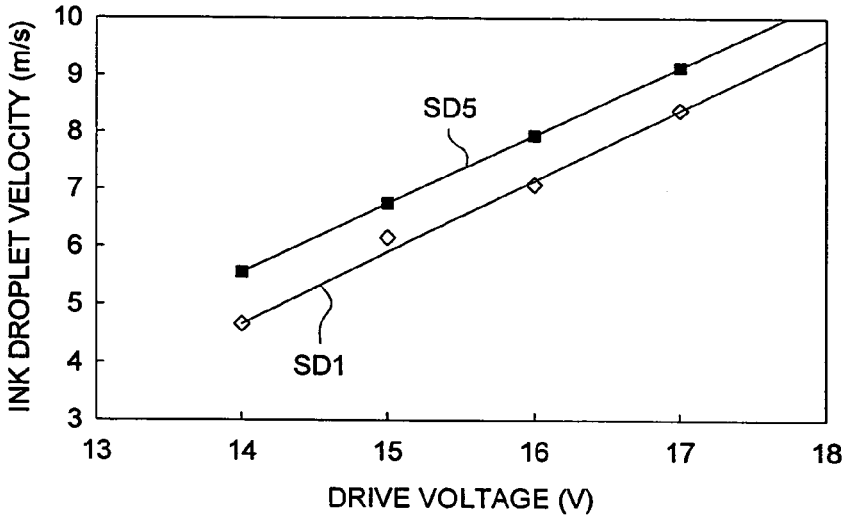
FIG. 10 is a graph of experimental data showing relationships between drive voltages and droplet velocities in accordance with the driving method of this invention.

FIG. 10 shows the relationship between drive voltages Von (V) of drive signals and ink droplet velocities (m/s) in Example 2. The horizontal axis represents drive voltages Von (V) and the vertical axis represents velocities (m/s) of ink droplets. In FIG. 10, points "◇" and line SD1 are for sub-droplet SD1 and points "■" and line SD5 are for sub-droplet SD5 when SD1 to SD5 are continuously ejected.

As shown in FIG. 10, the velocity of SD5 is greater than that of SD1 by 1 m/s or less (as a velocity increment) and sub-droplets are ejected steadily. This means that the pressure wave cancellations were implemented successfully. The velocity can be increased up to 11 m/s while droplets are ejected steadily.

By the way, FIG. 10 does not contain experimental data obtained by using drive pulses of Comparative Example 1 since the data is almost the same as that of Example 2.

Judging from the results of FIG. 9 and FIG. 10, we confirmed that the driving methods of Examples can obtain the same cancellation effects as those of the driving methods of Comparative Examples and greatly reduce the number of satellites.

Figure 11:
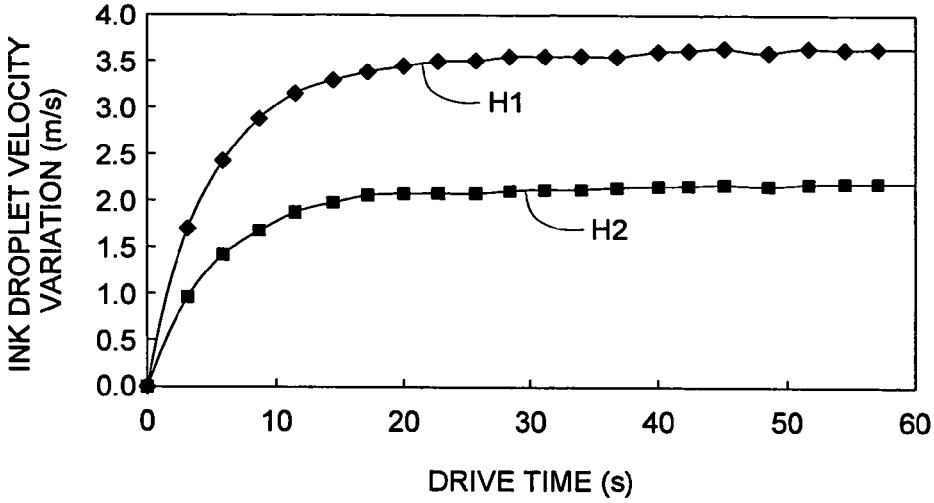
FIG. 11 is a graph of experimental data showing relationships between drive times and droplet velocity changes at different drive heat generation levels in accordance with the driving method of this invention.
Figure 12:
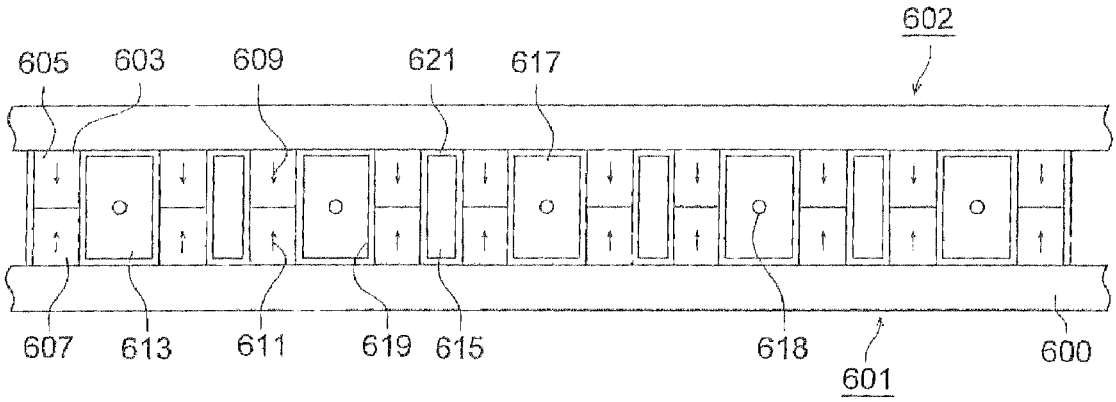
FIG. 12 (a) PRIOR ART
FIG. 12 shows an ink jet recording head of a prior art.
Figure 12:
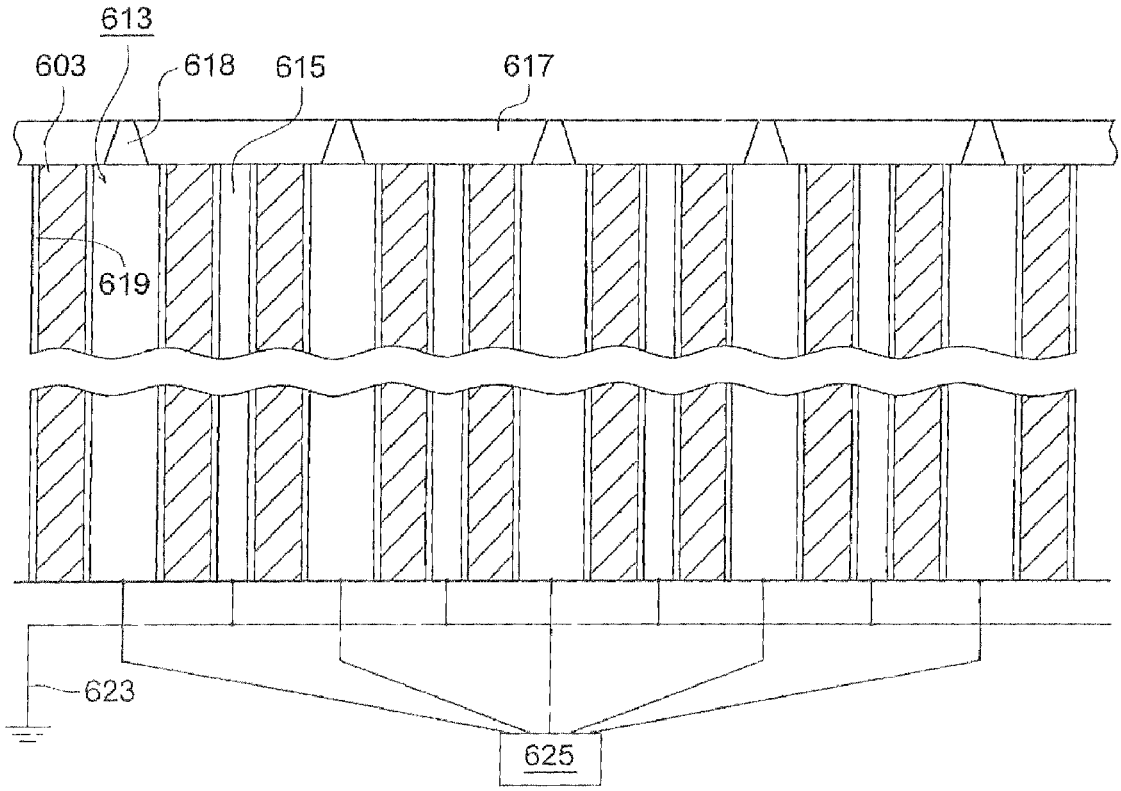
FIG. 12 (b) PRIOR ART
Figure 13:
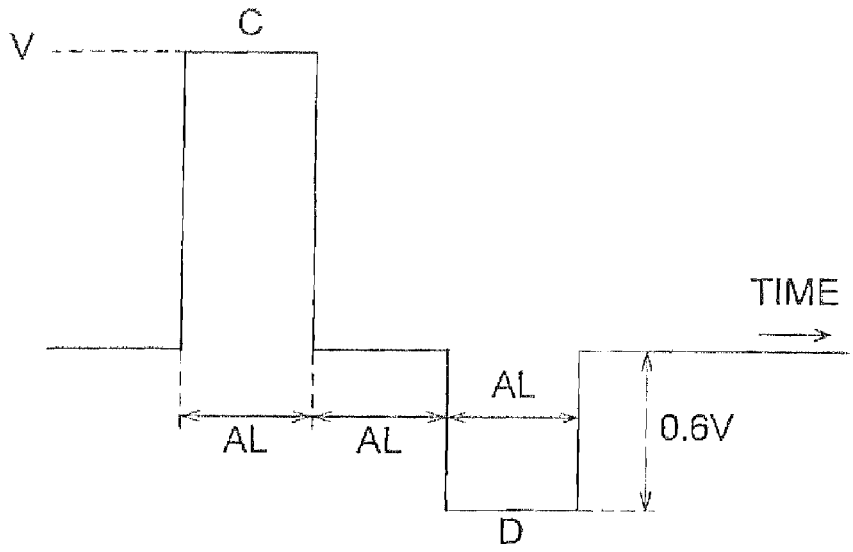
FIG. 13 PRIOR ART
FIG. 13 shows a driving method of a prior art.

In FIG. 11, the horizontal axis represents drive times (s) and the vertical axis represents velocity changes (velocity increment from 6 m/s) of ink droplets caused by heat generated during driving. In FIG. 11, points "◆" and line H1 are for Comparative Example 1 and points "■" and line H2 are for Example 2. Drive voltages Von to eject sub-droplet SD1 at 6 m/s is 21.9V for Comparative Examples and 16.4V for Examples. In other words, the drive voltage Von of Examples is lower by about 25%.

As shown in FIG. 11, it is found that the driving methods of Examples have smaller velocity changes than those of Comparative Examples. Electric power was controlled to keep the initial temperature of the ink heating heater at 50° C. The heater was not feedback-controlled after driving started. Therefore, a low velocity change means that the power consumption of drive pulses is little and the heat generation is suppressed. The inventors can confirm the effects that the driving method of this invention can suppress power consumption and heat generation during driving more than the driving methods of Comparative Examples.

The embodiments of this invention can bring about the following effects. By applying a first contraction pulse after an expansion pulse whose pulse width is 0.7 to 1.3 AL which is approximately 1 AL, the negative pressure wave caused by expansion of the pressure generation chamber at the start of application of the expansion pulse inverts at 1 AL into a positive pressure wave. A positive pressure wave caused by contraction is added to this inverted positive pressure wave. As the result, the droplet ejection pressure (ejection velocity) is enhanced and a high-efficient ejection force can be obtained. This can reduce the drive voltage and consequently reduce the power consumption of the pressurizing device.

After 1 AL later from this status, the pressure wave in the pressure generation chamber inverts to a negative pressure. Another 1 AL later, the pressure wave in the pressure generation chamber inverts to appositive pressure. After this, every 1 AL later, the pressure inversion is repeated between positive and negative and the pressure wave is attenuated. When the pressure wave in the pressure generation chamber inverts to a negative pressure after 1 AL from the start of application of the first contraction pulse, a force works to pull back the projected meniscus and make the lower part of the liquid pillar thinner. About this time, when the application of the first contraction pulse (0.3 to 1.5 AL as the pulse width) ends, the pressure generation chamber expands and a force works to pull back the meniscus further and make the lower part of the liquid pillar thinner. This quickens the separation of the liquid pillar from the meniscus and suppresses generation of satellite droplets. In other words, the tail of the liquid pillar is made shorter and generation of satellites is suppressed.

Further, the second contraction pulse after the first contraction pulse can cancel the pressure wave. This enables quick and steady ejection of the next droplet through the same nozzle. In other words, this can make the liquid droplet ejecting head driven at high-frequency to eject liquid droplets in a quick cycle.

The embodiments of this invention can bring about the following effects. By applying a first contraction pulse after an expansion pulse whose pulse width is 0.7 to 1.3 AL which is approximately 1 AL, the negative pressure wave caused by expansion of the pressure generation chamber at the start of application of the expansion pulse inverts at 1 AL into a positive pressure wave. A positive pressure wave caused by contraction is added to this inverted positive pressure wave. As the result, the droplet ejection pressure (ejection velocity) is enhanced and a high-efficient ejection force can be obtained. This can reduce the drive voltage and consequently reduce the power consumption of the pressurizing device.

After 1 AL later from this status, the pressure wave in the pressure generation chamber inverts to a negative pressure. Another 1 AL later, the pressure wave in the pressure generation chamber inverts to a positive pressure. After this, every 1 AL later, the pressure inversion is repeated between positive and negative and the pressure wave is attenuated. When the pressure wave in the pressure generation chamber inverts to a negative pressure after 1 AL from the start of application of the first contraction pulse, a force works to pull back the projected meniscus and make the lower part of the liquid pillar thinner. About this time, when the application of the first contraction pulse (2.5 to 3.5 AL as the pulse width) ends, the pressure generation chamber expands and a force works to pull back the meniscus further and make the lower part of the liquid pillar thinner. This quickens the separation of the liquid pillar from the meniscus and suppresses generation of satellite droplets. In other words, the tail of the liquid pillar is made shorter and generation of satellites is suppressed.

Further, the second contraction pulse after the first contraction pulse can cancel the pressure wave. This enables quick and steady ejection of the next droplet through the same nozzle. In other words, this can make the liquid droplet ejecting head driven at high-frequency to eject liquid droplets in a quick cycle.

The examples of this invention can bring about the following effects. It is possible to set the time interval between the trailing edge of the expansion pulse and the leading edge of the second contraction pulse to 0.7 to 1.3 AL which is about 1 AL by setting the pulse width of the first contraction pulse in the range of 0.3 to 1.0 AL. With this, when a positive pressure wave caused at the trailing end of the expansion pulse and the leading edge of the first contraction pulse inverts to a negative pressure after 1 AL, a positive pressure wave is added. This can enhance the effect to cancel the pressure wave and enables high-frequency driving.

Further, it is possible to enhance the effect to reduce satellites and the cancellation effect by the second contraction pulse by setting the time interval between the trailing edge of the first contraction pulse and the leading edge of the second contraction pulse to 0.3 AL or more.

The embodiments of this invention can bring about the following effects.

Since |Voff|=|V2 off| can be set (where Voff (V) is the drive voltage of the first contraction pulse and V2 off (V) is the drive voltage of the second contraction pulse), both first and second pulses can be generated by a single power supply. This can reduce the power cost.

In accordance with embodiments of this invention, since the drive signal can eject multiple liquid droplets in sequence in a preset drive cycle, the number of liquid droplets to be landed on a single dot on a recording medium can be controlled in multiple stages.

What is claimed is:

1. A liquid droplet ejecting apparatus comprising:

a pressurizing device to be operated by a drive signal;

a pressure generation chamber whose volume is expanded and contracted by a movement of the pressurizing device;

a liquid droplet ejecting head having a nozzle communicating with the pressure generation chamber; and a drive signal generator which generates the drive signal for operating the pressurizing device, and causing expanding and contracting of a volume of the pressure generation chamber to eject liquid droplets through the nozzle, wherein the drive signal comprises:

an expansion pulse to expand the volume of the pressure generation chamber from the volume of a neutral position;

a first contraction pulse following the expansion pulse to contract the volume of the pressure generation chamber from the volume of the neutral position; and a second contraction pulse after the first contraction pulse to contract the volume of the pressure generation chamber from the volume of the neutral position, wherein a pulse width of the expansion pulse is 0.7 AL through 1.3 AL, and a pulse width of the first contraction pulse is 0.3 AL through 1.5 AL, where AL is ½ of an acoustic resonance period of the pressure generation chamber.

2. The liquid droplet ejecting apparatus of claim 1, wherein the pulse width of the first contraction pulse in the drive signal is 0.3 AL to 1.0 AL, the time interval between the trailing edge of the expansion pulse and the leading edge of the second contraction pulse is 0.7 AL to 1.3 AL, and a time interval between a trailing edge of the first contraction pulse and a leading edge of the second contraction pulse is 0.3 AL or more.

3. The liquid droplet ejecting apparatus of claim 2, wherein |Voff|=|V2off|, where Voff (V) is the drive voltage of the first contraction pulse and V2off (V) is the drive voltage of the second contraction pulse.

4. The liquid droplet ejecting apparatus of claim 3, wherein the drive signal comprises plural groups of pulses, each of the plural groups containing the expansion pulse, the first contraction pulse, and the second contraction pulse, in an identical drive cycle to eject liquid droplets in succession.

5. The liquid droplet ejecting apparatus of claim 2, wherein the drive signal comprises plural groups of pulses, each of the plural groups containing the expansion pulse, the first contraction pulse, and the second contraction pulse, in an identical drive cycle to eject liquid droplets in succession.

6. The liquid droplet ejecting apparatus of claim 1, wherein |Voff|=|V2off|, where Voff (V) is the drive voltage of the first contraction pulse and V2off (V) is the drive voltage of the second contraction pulse.

7. The liquid droplet ejecting apparatus of claim 6, wherein the drive signal comprises plural groups of pulses, each of the plural groups containing the expansion pulse, the first contraction pulse, and the second contraction pulse, in an identical drive cycle to eject liquid droplets in succession.

8. The liquid droplet ejecting apparatus of claim 1, wherein the drive signal comprises plural groups of pulses, each of the plural groups containing the expansion pulse, the first contraction pulse, and the second contraction pulse, in an identical drive cycle to eject liquid droplets in succession.

9. A liquid droplet ejecting apparatus comprising:

a pressurizing device to be operated by a drive signal;

a pressure generation chamber whose volume is expanded and contracted by a movement of the pressurizing device;

a liquid droplet ejecting head having a nozzle communicating with the pressure generation chamber; and a drive signal generator which generates the drive signal for operating the pressurizing device, and causing expansion and contraction of a volume of the pressure generation chamber to eject liquid droplets through the nozzle, wherein the drive signal comprises:

an expansion pulse to expand the volume of the pressure generation chamber from the volume of a neutral position;

a first contraction pulse following the expansion pulse to contract the volume of the pressure generation chamber from the volume of the neutral position; and a second contraction pulse after the first contraction pulse to contract the volume of the pressure generation chamber from the volume of the neutral position, wherein a pulse width of the expansion pulse is 0.7 AL through 1.3 AL, and a pulse width of the first contraction pulse is 2.5 AL through 3.5 AL, where AL is ½ of an acoustic resonance period of the pressure generation chamber.

10. The liquid droplet ejecting apparatus of claim 9, wherein |Voff|=|V2off|, where Voff (V) is the drive voltage of the first contraction pulse and V2off (V) is the drive voltage of the second contraction pulse.

11. The liquid droplet ejecting apparatus of claim 10, wherein the drive signal comprises plural groups of pulses, each of the plural groups containing the expansion pulse, the first contraction pulse, and the second contraction pulse, in an identical drive cycle to eject liquid droplets in succession.

12. The liquid droplet ejecting apparatus of claim 9, wherein the drive signal comprises plural groups of pulses, each of the plural groups containing the expansion pulse, the first contraction pulse, and the second contraction pulse, in an identical drive cycle to eject liquid droplets in succession.

13. A method of driving a liquid droplet ejecting head by applying a drive signal to a pressurizing device which is operated by drive signals, causing the volume of the pressure generation chamber to expand and contract and ejecting a liquid droplet through a nozzle communicating with the pressure generation chamber, wherein the drive signal comprises:

an expansion pulse to expand the volume of the pressure generation chamber from the volume of a neutral position;

a first contraction pulse following the expansion pulse to contract the volume of the pressure generation chamber from the volume of the neutral position; and a second contraction pulse after the first contraction pulse to contract the volume of the pressure generation chamber from the volume of the neutral position, wherein a pulse width of the expansion pulse is 0.7 AL through 1.3 AL, and a pulse width of the first contraction pulse is 0.3 AL through 1.5 AL, where AL is ½ of an acoustic resonance period of the pressure generation chamber.

14. A method of driving a liquid droplet ejecting head by applying a drive signal to a pressurizing device which is operated by drive signals, causing the volume of the pressure generation chamber to expand and contract and ejecting a liquid droplet through a nozzle communicating with the pressure generation chamber, wherein the drive signal comprises:

an expansion pulse to expand the volume of the pressure generation chamber from the volume of a neutral position;

a first contraction pulse following the expansion pulse to contract the volume of the pressure generation chamber from the volume of the neutral position; and a second contraction pulse after the first contraction pulse to contract the volume of the pressure generation chamber from the volume of the neutral position, wherein a pulse width of the expansion pulse is 0.7 AL through 1.3 AL, and a pulse width of the first contraction pulse is 2.5 AL through 3.5 AL, where AL is ½ of an acoustic resonance period of the pressure generation chamber.

* * * * *